US009320086B2

(12) United States Patent
Strehlow et al.

(10) Patent No.: US 9,320,086 B2
(45) Date of Patent: Apr. 19, 2016

(54) FAIL SAFE HEATER ASSEMBLY

(71) Applicant: Minco Products, Inc., Minneapolis, MN (US)

(72) Inventors: Russell H. Strehlow, St. Paul, MN (US); Matthew J. Fuhs, Anoka, MN (US); Jamin Robert Taylor, Coon Rapids, MN (US); Scott A. Dupay, Blaine, MN (US)

(73) Assignee: Minco Products, Inc., Minneapolis, MN (US)

( * ) Notice: Subject to any disclaimer, the term of this patent is extended or adjusted under 35 U.S.C. 154(b) by 349 days.

(21) Appl. No.: 13/939,399

(22) Filed: Jul. 11, 2013

(65) Prior Publication Data

US 2015/0014301 A1 Jan. 15, 2015

(51) Int. Cl.
*H05B 3/06* (2006.01)
*H05B 3/26* (2006.01)

(52) U.S. Cl.
CPC ..... *H05B 3/26* (2013.01); *H05B 2203/003* (2013.01); *H05B 2203/007* (2013.01); *H05B 2203/013* (2013.01)

(58) Field of Classification Search
CPC ..... G05D 23/24; G05D 23/12; G05D 23/122; H05B 3/00; H05B 3/26; H05B 3/0014; H05B 3/0023; H05B 3/267; H05B 3/28; H05B 3/286; H05B 3/34; H05B 3/36; H05B 3/38; H05B 2203/013; H05B 2203/017; H05B 2203/003; H05B 2203/004; H05B 2203/002; H05B 2203/007
See application file for complete search history.

(56) References Cited

U.S. PATENT DOCUMENTS

2003/0183620 A1* 10/2003 Wong

* cited by examiner

*Primary Examiner* — Shawntina Fuqua
(74) *Attorney, Agent, or Firm* — Dicke, Billig & Czaja, PLLC

(57) ABSTRACT

A fail safe heating assembly for operative union with a heat sink and/or work piece is provided. The assembly generally includes a heater characterized by a resistive heating element and a dielectric substrate, and a resistive sensor, substantially coextensive with the resistive heating element of the heater and united therewith so as to define a composite heating assembly. The resistive heating element is supported upon the dielectric substrate, with the heater including leads for operative union with a current source. The resistive sensor is characterized by a first resistive sensor portion having a resistive material delimiting a first resistive pattern, and a second resistive sensor portion having a resistive material delimiting a second resistive pattern.

20 Claims, 8 Drawing Sheets

FAIL SAFE HEATER ASSEMBLY

TECHNICAL FIELD

The present invention generally relates to conduction based heating systems, more particularly, to heater failure detection, and more particularly still, the detection of localized diminished heat transfer within a system generally characterized by a thermo-electric heater, a resistive sensor, and an associated heat sink and/or workpiece.

BACKGROUND OF THE INVENTION

Systems or devices that require thermal conditioning, i.e., heating or cooling, more often than not require at least a portion thereof to fall within a specific thermal profile in order to function optimally or properly. With regard to conduction based heating systems (i.e., those characterized by a transfer of thermal energy between adjacent bodies or parts thereof owing to the presence of a temperature gradient), thermo-electric heaters are commonly used to produce and input required heat. Such heaters convert electrical energy into heat energy and provide a motive thermal force for conductive heat transfer.

Thermo-electric heaters are generally either applied to a non-working surface area on, or embedded within, the bulk of a mass, generally called a heat-sink, on which the working surface resides. In the context of a thermal conditioning system comprised of a thermo-electric heater and heat sink, temperature sensing and monitoring is advantageously undertaken to measure and indicate system temperatures, advantageously as a function of time, in relation to the heat-sink in furtherance of providing input or feedback to a control system.

Meaningful conductive heat transfer is premised upon substantial, uniform, homogeneous physical contact between, for and among the thermo-electric heater and the heat-sink. In instances when physical contact is lost, conductive heat transfer is lost. In instances where only a portion of the original contact area is lost the system may still be able to maintain the temperature of the heat-sink in the vicinity of the heat sensing element, however, the local or localized temperature at the point where the heater and the heat-sink have separated is likely to be drastically altered (i.e., greatly departed from that indicated by the heat sensing element). Moreover, while the heat-sink temperature at the separation local will thusly be lower than what is generally intended, the temperature of the thermo-electric heater at that local will be higher. This can have at least two detrimental effects.

On the heat-sink, the temperature may drop below the select, necessary temperature required for a chemical or physical process to occur or proceed, especially time critical processes. For example, process gases of a semiconductor processing chamber may not fully react with a top surface of a silicon wafer under process, or the surface temperature on the leading edge of an aircraft wing may not reach the temperature necessary to shed built up ice.

Within the thermo-electric heater, at the local where the heater and the heat-sink have separated, the heating element continues to generate the same quantity of heat as when the now locally disassociated elements were operatively united/associated, however, the generated heat has a much smaller means of conducting out, hence the thermo-electric heater element temperature, and its associated, surrounding electrical insulation, rapidly increase in temperature. Depending upon the magnitude of the temperature rise and/or its profile (i.e., temporal rate of change), the thermo-electric heater element electrical insulation can experience a change in its electrical insulating properties, outgas volatile compounds into the environment, or even combust. With regard to the heating element of the thermo-electric heater, degradation in the form or fracturing, melting, etc. often occurs, with the imparted system stress potentially resulting in the ignition of local/localized gases and/or materials adjacent to or in the vicinity of the thermo-electric heater element.

In light of the foregoing, an elegantly simple and reliable heater failure detection approach remains warranted. More particularly, a solution or solutions to heater failure detection over considerable temperature and power densities is believed advantageous and desirable. More particularly still, there remains outstanding a need for a readily monitorable fail safe heater assembly characterized by a thermo-electric heater, a resistive sensor, and an optionally integral heat sink.

SUMMARY OF THE INVENTION

A heating assembly for operative union with a heat sink and/or work piece is generally provided. More particularly, a fail safe heating assembly for operative union with a heat sink and/or work piece is provided.

The heating assembly generally includes a heater characterized by a resistive heating element and a dielectric substrate, and a resistive sensor, substantially coextensive with the resistive heating element of the heater and operatively united therewith so as to define a composite heating assembly. The resistive heating element is supported upon the dielectric substrate, with the heater including leads for operative union with a current source. The resistive sensor comprises a first resistive sensor portion characterized by a resistive material delimiting a first resistive pattern, and a second resistive sensor portion characterized by a resistive material delimiting a second resistive pattern. The resistive sensor is monitorable in real time for a detection of a change in a resistance related parameter related to a change in a conductance interface for, between and among the heater and the heat sink and/or work piece.

In a contemplated embodiment, the resistive sensor is characterized by a first resistive sensor portion having a first resistive element and a second resistive sensor portion having a second resistive element. The first resistive element include leads for operative union with a real time monitoring system, and the second resistive element likewise includes leads for operative union with the real time monitoring system. Comparative zone resistance sensing/monitoring of each of the resistive elements of the resistive sensor thereby effectuated in furtherance of detection of a change in a conductive interface for, between and among said heater and the heat sink and/or work piece.

In a further contemplated embodiment, the resistive sensor is characterized by a first resistive sensor portion having a resistive material delimiting a first resistive pattern, and a second resistive sensor portion having a resistive material delimiting a second resistive pattern. The first resistive pattern and the second resistive pattern are conductively united so as to delimit a resistive element/circuit. The resistive element includes leads for operative union with a real time monitoring system in furtherance of detection of a change in a conductive interface for, between and among said heater and the heat sink and/or work piece. More specific features and advantages obtained in view of those features will become apparent with reference to the drawing figures and DETAILED DESCRIPTION OF THE INVENTION.

BRIEF DESCRIPTION OF THE DRAWINGS

The assembly or assemblies, subassemblies, structures and/or elements disclosed directly or implicitly herein may be embodied in other specific forms without departing from the spirit or general characteristics thereof, some of which forms have been indicated. Thus, the features described and depicted herein/herewith are to be considered in all respects illustrative and not restrictive with the following brief description of the drawings and their content provided.

DETAILED DESCRIPTION OF THE INVENTION

Broadly, a fail safe heating assembly is provided, more particularly, a fail safe heating assembly for operative union with a heat sink and/or a work piece. In advance of a description of contemplated assemblies and subassemblies, a few general remarks are to be noted.

First, the instant fail safe heating assembly is generally and broadly characterized by a heater and a resistive sensor substantially coextensive with a resistive heating element of the heater. The resistive sensor is united therewith so as to define, form, or delimit a composite or laminated assembly. Moreover, the contemplated assembly may be adapted for intimate, thorough, contacting engagement to/with a heat sink/work piece surface, as for example, via the inclusion of an acrylic or silicone based pressure sensitive adhesive (PSA), a thermoplastic, thermosetting adhesive or epoxy or like material upon a surface of the heater of the assembly, or the assembly may selectively and operatively include a heat sink or the like so as to be integral therewith.

Second, and as will be appreciated by those of ordinary skill in the art, the subject description proceeds in the context of a heater characterized by a resistive heating element and a dielectric substrate supporting same, more particularly, and advantageously, but not necessarily, a Thermofoil™ etched-foil resistive heater from Minco Products, Inc., Minneapolis, Minn., USA, more particularly still, a polyimide thermofoil heater. Be that as it may, other resistive element heaters may be utilized/readily adapted for inclusion part-and-parcel of the generally contemplated fail safe heating assembly, for example and without limitation, silicone rubber thermofoil heaters, standard polyimide and rubber heaters, wire wound rubber heaters, mica heaters, thermal clear transparent heaters and/or all polyimide heaters as the case may be.

Figure 1A:
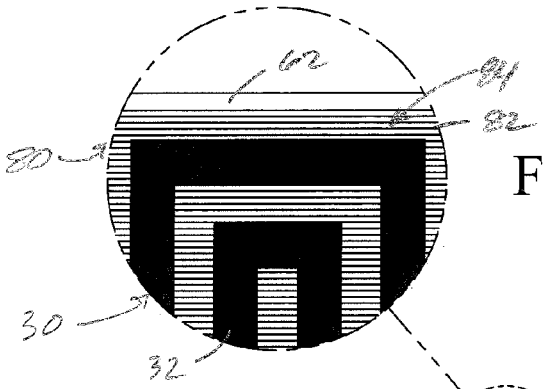
FIG. 1A depicts a detailed view of area 1A of FIG. 1.
Figure 1:
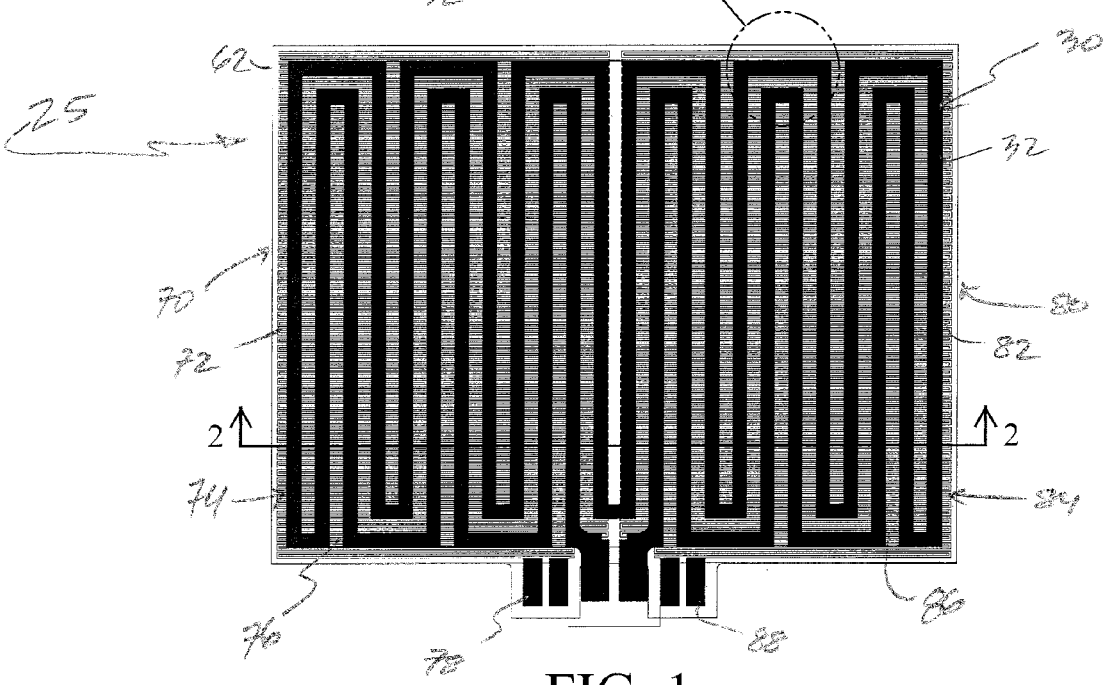
FIG. 1 depicts, in plan view, a contemplated fail safe heater assembly, namely, a comparative zone sensing fail safe heater assembly.
Figure 6:
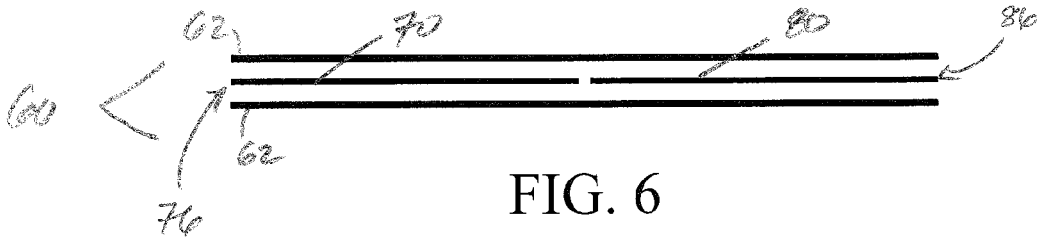
FIG. 6 depicts, sectional view, the resistive sensor of FIG. 5 in relation to section line 6-6.
Figure 7:
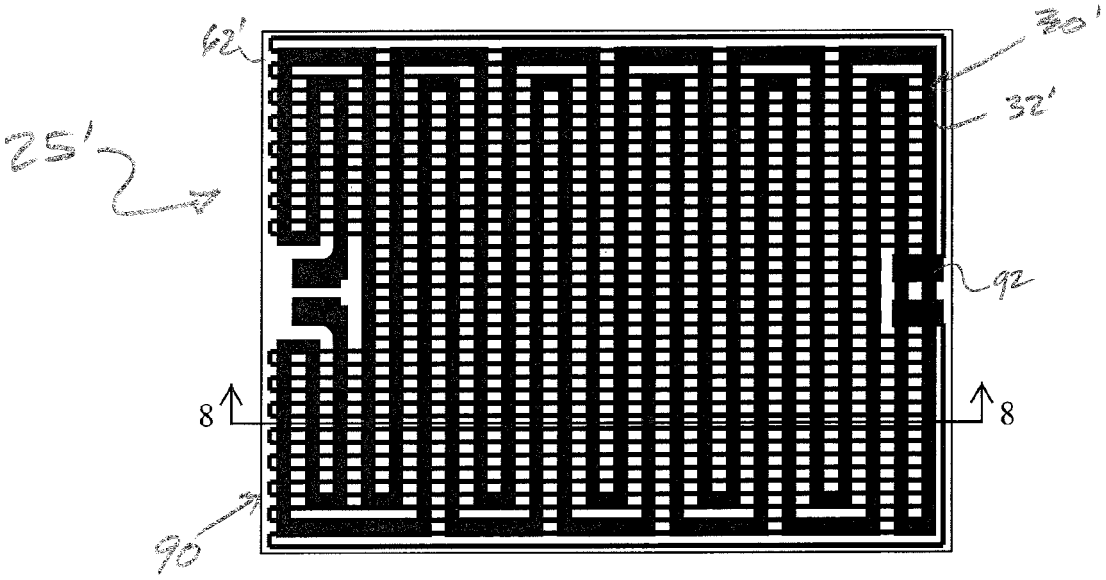
FIG. 7 depicts, in plan view, a further contemplated fail safe heater assembly, namely, a thermal fuse fail safe heater assembly.

Third, while the contemplated resistive sensor of the fail safe heating assembly generally comprises a first resistive sensor portion having a resistive material delimiting a first resistive pattern, and a second resistive sensor portion having a resistive material delimiting a second resistive pattern, notionally and advantageously, the resistive sensor is monitorable in real time for a detection of a change in a resistance related parameter related to a change in a conductive interface for, between and among the heater and the heat sink and/or work piece. As the instant description proceeds in the context of a comparative zone sensing fail safe heater (FIG. 1), and components thereof (FIGS. 2-6), characterized by a first resistive sensor, and thereafter in connection to a thermal fuse fail safe heater (FIG. 6), and components thereof (FIGS. 7-16), characterized by a second resistive sensor, alternate sensor assemblies or elements are to be readily appreciated by those of ordinary skill in the art for use/adaptation with regard to the after described fail safe heater.

Figure 2:
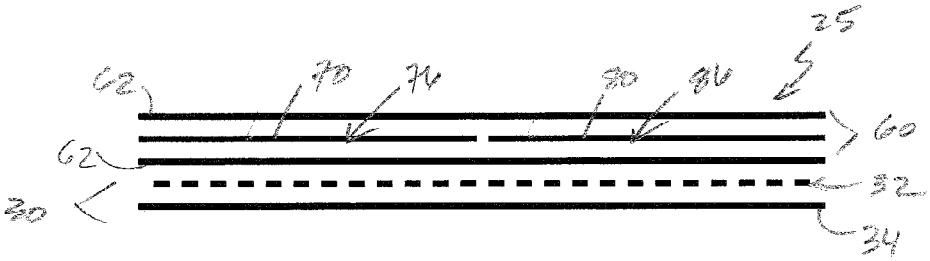
FIG. 2 depicts, sectional view, the assembly of FIG. 1 in relation to section line 2-2.
Figure 3:
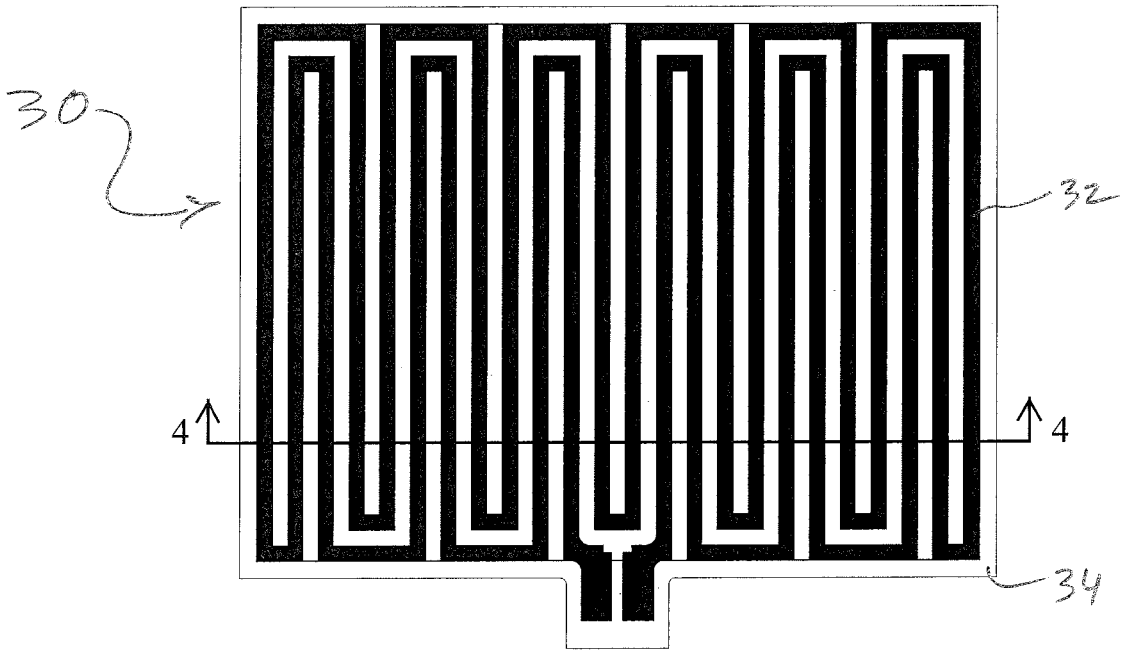
FIG. 3 depicts, in plan view, an illustrative non-limiting heater of the FIG. 1 assembly.
Figure 4:
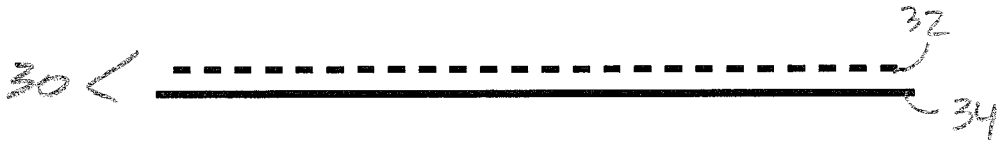
FIG. 4 depicts, sectional view, the heater of FIG. 3 in relation to section line 4-4.
Figure 5:
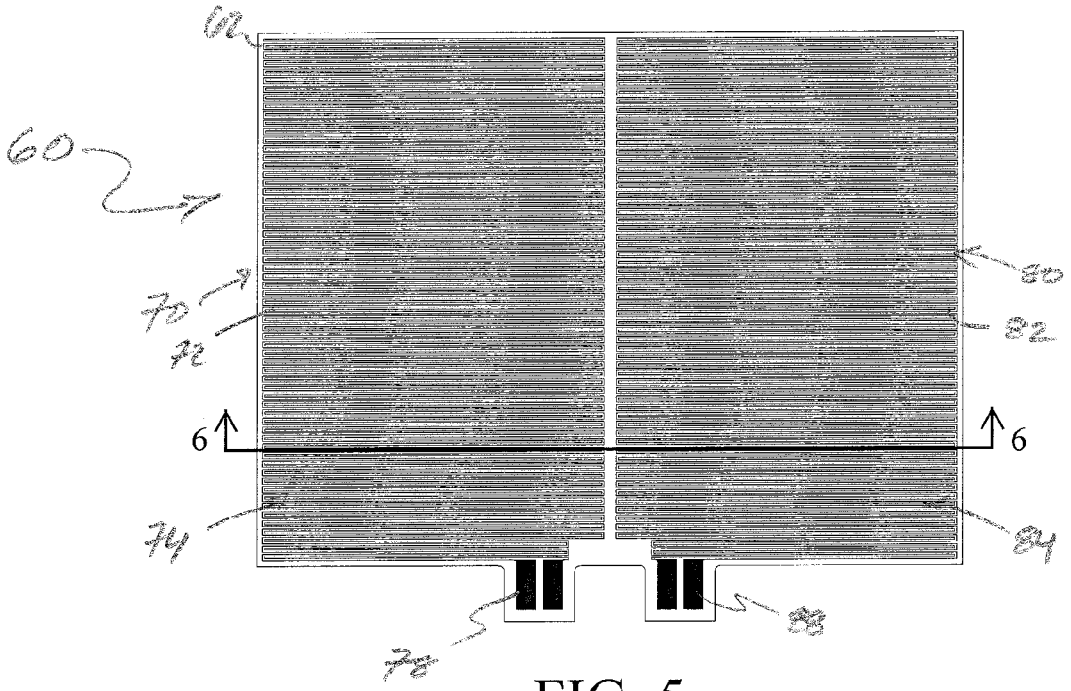
FIG. 5 depicts, in plan view, an illustrative non-limiting resistive sensor of the FIG. 1 assembly.

With reference now to FIGS. 1 & 2, and FIGS. 3-6, there is shown a contemplated fail safe heater assembly 25, and components thereof, namely, a heater 30 (FIG. 3) and a resistive sensor 60, in the form of a comparative zone sensor (FIG. 5), and their relationship/interrelationship with regard to each other in the context of the composite assembly (FIG. 2). As best seen in connection to the sectional view of FIG. 2, the assembly stack up includes a plurality of discrete elements, e.g., lamina, with each of the heater (FIG. 4) and the resistive sensor (FIG. 6) comprising plural elements, advantageously in the form of united lamina.

The heater (FIGS. 3 & 4) of the assembly generally comprises a resistive heating element 32, for example and advantageously as shown, a foil resistive heating element, and a dielectric element or substrate 34, for example and advantageously as shown, a dielectric base (e.g., a polyimide or a polyether ether ketone film). Generally, resistive heating element 32 is support upon/by dielectric substrate 34, more particularly, in the illustrative non-limiting context of an etched foil resistive heating element, it is united with the dielectric substrate via an adhesive or bond layer, e.g., a fluorinated ethylene propylene resin (e.g., Teflon® FEP), not shown. Conventional fabrication is generally contemplated with regard to the heater of the assembly, with a representative, non-limiting heater characterized by a 0.001" polyimide film dielectric base and a 0.0006" copper nickel (CuNi) alloy resistive heating element united thereto by a 0.0005" FEP film, or other suitable adhesive/bond layer. Advantageously, but not necessarily, the resistive heating element covers 50% or more of the effective heating area of the heater.

The resistive sensor (FIGS. 5 & 6) of the assembly is generally characterized by a first resistive sensor portion 70 having a resistive material 72 delimiting a first resistive pattern 74, and a second resistive sensor portion 80 having a resistive material 82 delimiting a second resistive pattern 84. More particularly, resistive sensor 60 is characterized by first resistive sensor portion 70 having first resistive element 76 and second resistive sensor portion 80 having second resistive element 86. The resistive material, and thus the discrete resistive elements, is fixedly interposed between dielectric elements or substrates 62, i.e., layers in the form of conventional films (e.g., a polyimide or a polyether ether ketone film) that delimit a cover or covering. First resistive element 76 includes leads 78 for operative union with a real time monitoring system (not shown), and second resistive element 86 likewise includes leads 88 for operative union with the real time monitoring system. Notionally, comparative resistance monitoring of each of the resistive elements of the resistive sensor thereby effectuates a detection in or of a change in a conductive interface for, between and among the heater and the heat sink and/or work piece.

As with the heater, conventional fabrication is generally contemplated with regard to the resistive sensor of the instant assembly, with a representative, non-limiting comparative zone resistive sensor characterized by a 0.001" nickel iron (NiFe) resistive sensing layer, namely, adjacent substantially identically configured resistive elements, fixedly interposed between 0.001" polyimide film dielectric covers via 0.0005" FEP film, or other suitable adhesive/bond layers.

As should be appreciated with regard to a comparative zone resistive sensing, two or more zones delimited by substantially identical resistive patterns, more particularly, elements, are necessary to effectuate the sought after detection, e.g., comparative rates of change of resistance between, for and/or among the zones. Moreover, as is to be appreciated with comparison of FIGS. 1 & 5 and FIGS. 2 & 6, resistive sensor 60 is coextensive with heater 30, more particularly, resistive elements 76, 86 of the resistive sensor 60 are to, in combination, cover the entirety of resistive heating element 32 of heater 30 (i.e., with reference to FIG. 2, each resistive element traversingly overlies twelve of twenty-four segments of the resistive heating element). Advantageously, but not necessarily, the resistive sensing elements comprise a foil line having a width of about 0.010" or less, with spaces between the lines being less than or equal to the width of the foil lines.

Figure 8:
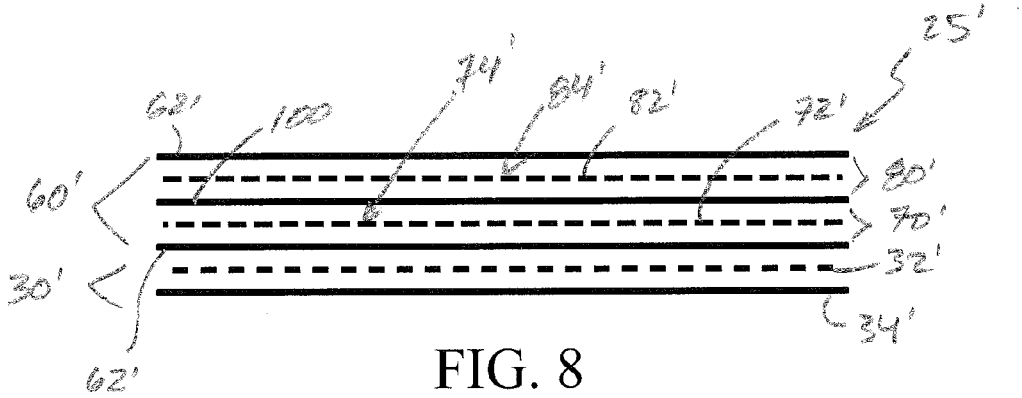
FIG. 8 depicts, sectional view, the assembly of FIG. 7 in relation to section line 8-8.
Figure 9:
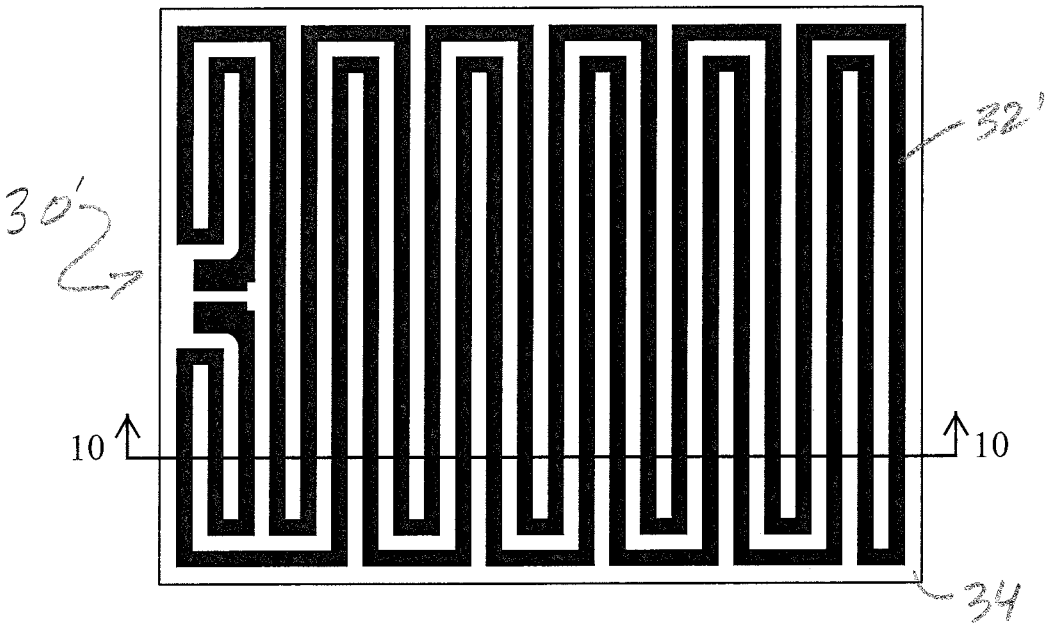
FIG. 9 depicts, in plan view, an illustrative non-limiting heater of the FIG. 7 assembly.
Figure 10:
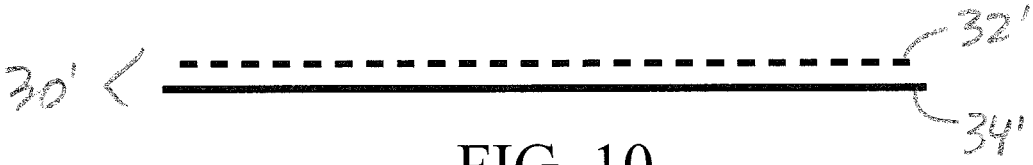
FIG. 10 depicts, sectional view, the heater of FIG. 9 in relation to section line 10-10.
Figure 11:
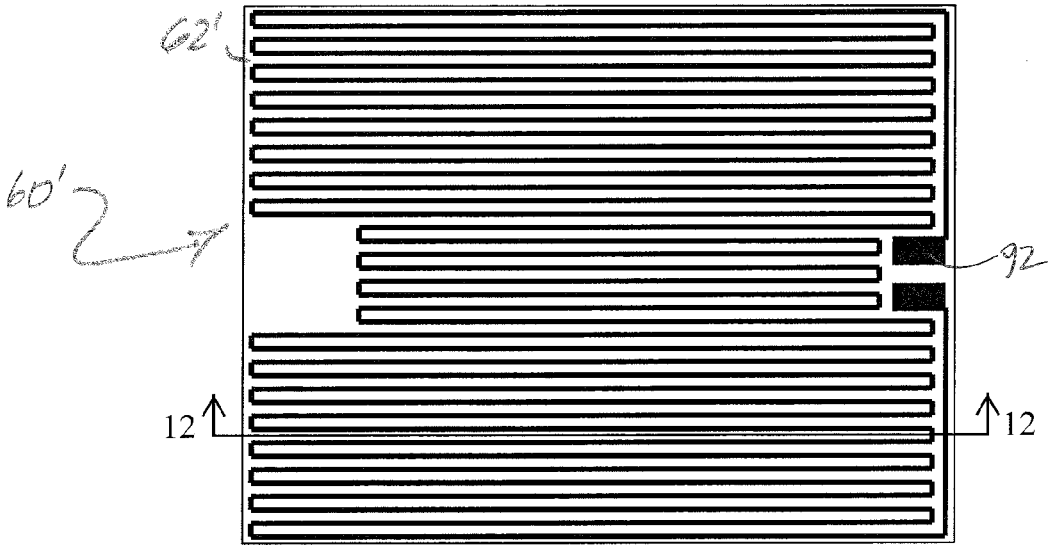
FIG. 11 depicts, in plan view, an illustrative non-limiting resistive sensor of the FIG. 7 assembly.
Figure 12:
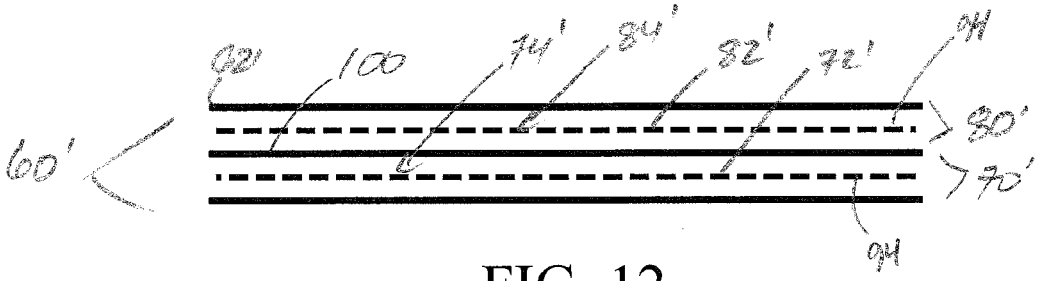
FIG. 12 depicts, sectional view, the resistive sensor of FIG. 11 in relation to section line 12-12.
Figure 13:
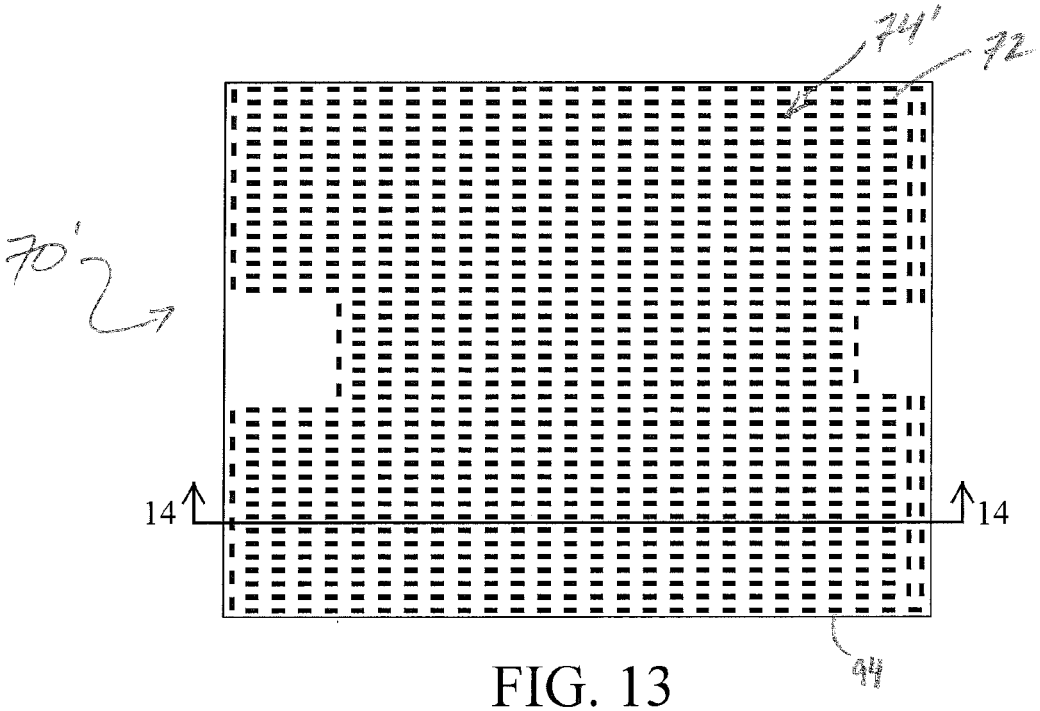
FIG. 13 depicts, plan view, a first portion of the resistive sensor of FIG. 11.
Figure 14:
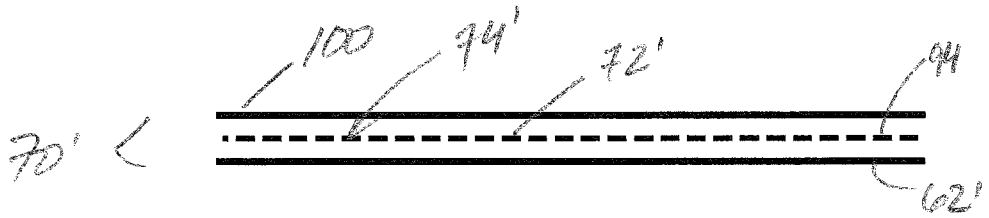
FIG. 14 depicts, sectional view, the first portion of the resistive sensor of FIG. 11 in relation to section line 14-14.
Figure 15:
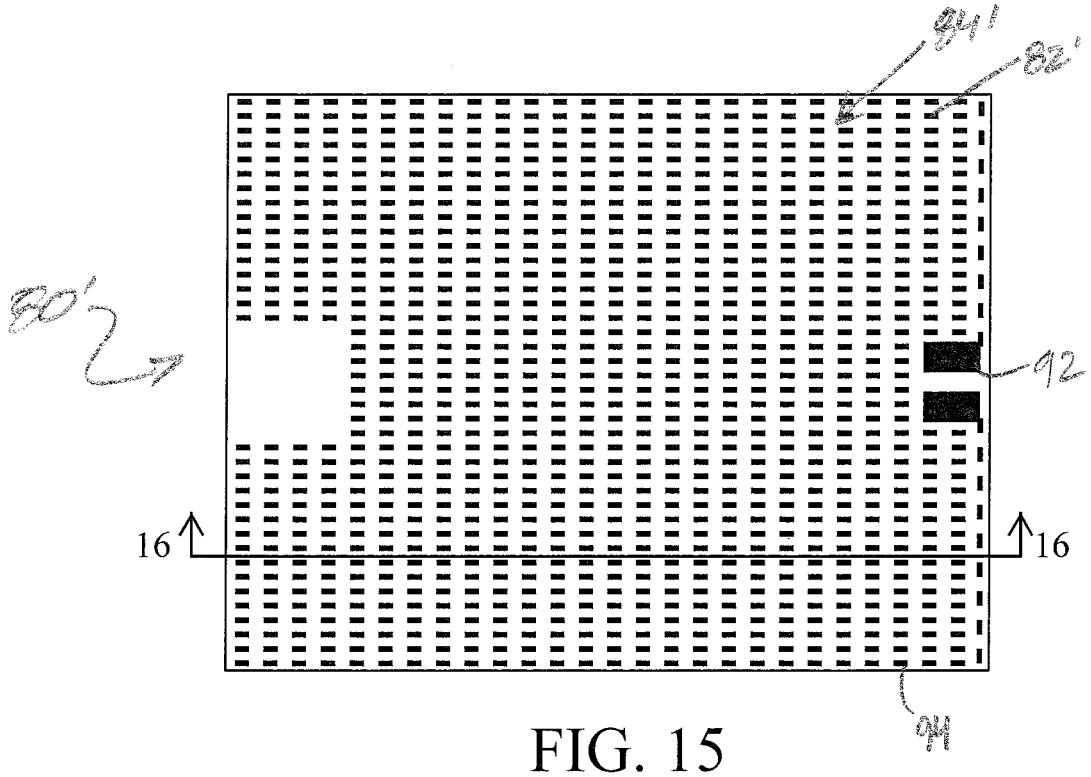
FIG. 15 depicts, plan view, a second portion of the resistive sensor of FIG. 11; and, FIG. 16 depicts, sectional view, the second portion of the resistive sensor of FIG. 11 in relation to section line 16-16.
Figure 16:
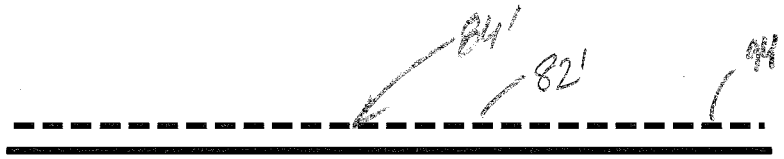

With reference now to FIGS. 7 & 8, and FIGS. 9-12, there is shown a further contemplated fail safe heater assembly 25', and components thereof, namely, a heater 30' (FIG. 9) and a resistive sensor 60' (FIG. 11), in the form of a thermal fuse, and their relationship/interrelationship with regard to each other in the context of the composite assembly (FIG. 8). As best seen in connection to the sectional view of FIG. 2, the assembly stack up includes a plurality of discrete elements, e.g., lamina, with each of heater 30' (FIG. 10) and resistive sensor 60' (FIG. 12) comprising plural elements, advantageously in the form of united lamina. More particularly, resistive sensor 60' advantageously comprises a first resistive sensor portion 70' (FIG. 13) having a resistive material 72' delimiting a first resistive pattern 74', and a second resistive sensor portion 80' (FIG. 15) having a resistive material 82' delimiting a second resistive pattern 84', the resistive patterns conductively united or joined so as to delimit a resistive element, i.e., a thermal fuse (FIG. 11).

The heater 30' (FIGS. 9 & 10) of assembly 25' generally comprises resistive heating element 32', for example and advantageously as shown, a foil resistive heating element, and a dielectric element or substrate 34', for example and advantageously as shown, a dielectric base (e.g., a polyimide or a polyether ether ketone film) for supporting same. Generally, form fits function with regard to the heaters of the contemplated assemblies, with particulars of the instant heater not inconsistent with the description previously set forth in connection to the heater of the fail safe heater assembly of FIG. 1. Like the heater of the comparative zone fail safe heater assembly, the heater of the thermal fuse fail safe heater assembly is united with or bonded to the resistive sensor, i.e., resistive circuit.

The resistive sensor 60' (FIGS. 11 & 12) generally comprises first 70' and second 80' sensing circuit portions, namely, first (FIGS. 13 & 14) and second (FIGS. 15 & 16) sensing circuit layers. The circuit portions 70', 80' are operatively united, i.e., conductively united, with the circuit or resistive element so formed characterized by leads 92 for operative union with a real time monitoring system in furtherance of detection of a change in a conductive interface for, between and among said heater and the heat sink and/or work piece.

As best appreciated with reference to FIGS. 11-16, each circuit portion 70', 80' (FIG. 13 & FIG. 15) of resistive sensor 60' (FIG. 11) includes resistive material 72', 82' supported by or upon a dielectric element or substrate 62', more particularly, discrete resistive material elements, e.g., pads 94 as shown, are provided and selectively configured, patterned and/or arranged in/as a 2D array for each of the first (FIG. 13) and second (FIG. 15) circuit forming layers. While having seemingly similar patterns, layouts for the elements are generally off-set, i.e., the layout of the element pattern for one circuit portion relative to the layout of the element pattern for the other circuit portion is off-set or shifted such that the "gaps" (e.g., white-space) of the first portion appear "filled" by the elements of the second portion upon overlain registration of the portions. A conductive adhesive layer 100, i.e., a z-axis conductive adhesive, e.g., an epoxy or PSA based adhesive, is utilized to link the resistive material element arrays of the discrete resistive element portions or layers 70', 80', and thereby form a resistive 3D array element, i.e., thermal fuse.

As with the heater, conventional fabrication is generally contemplated with regard to the resistive sensor of the instant assembly. A representative, non-limiting thermal fuse resistive sensor is advantageously characterized by a first resistive sensor portion having a 0.001" (or thinner) copper (Cu) resistive sensing material supported by/upon a 0.001" polyimide film dielectric substrate, and a similarly characterized second resistive sensor portion, a 0.001" epoxy based or PSA based (for lower temperature sensing) z-axis conductive adhesive operatively uniting the resistive sensor portions. Advantageously, but not necessarily, the operative combination of the two sensing circuit layers form z-axis junctions every 0.1" along their conductive path. Finally, as was the case in connection to the FIG. 1 assembly, the resistive heating element of the instant assembly advantageously covers in excess of 50% of the effective heating area of the assembly.

Having described illustrative, non-limiting preferred embodiments for a fail safe heater assembly, several operational or functional considerations are to be noted. Typical operating temperatures contemplated range from about 0-250° C., with contemplated power densities within a range of about 5-100 W/in$^2$. More particularly, the assembly characterized by comparative zone resistive sensing advantageously operates with ranges of about 0-125° C. and about 10-60 W/in$^2$, and may be suitably adapted so as to include a heat spreader to thereby extend the upper limit of power density up to about 80 W/in$^2$, with the assembly characterized by thermal fuse resistive sensing advantageously operating with ranges of about 0-250° C. and about 50-100 W/in$^2$, with diminishing operability at power densities less than about 55 W/in$^2$ (i.e., utility in the range combinations of about 125-190° C. and 25-55 W/in$^2$, and about 190-250° C. and 5-25 W/in$^2$). Moreover, and as is generally consistent and/or characteristic of the differing resistive sensors of the contemplated assemblies, while comparative zone resistive sensing leverages processor based supporting electronics, operates at low to moderate temperatures, is predictive and capable of calibration, thermal fuse resistive sensing leverages simple, lower cost supporting electronics, and operates at high power densities and/or high temperatures versus zone resistive sensing.

Finally, since the structures of the assemblies, subassemblies, and/or mechanisms disclosed herein may be embodied in other specific forms without departing from the spirit or general characteristics thereof, some of which forms have been indicated, the embodiments described and depicted herein/with are to be considered in all respects illustrative and not restrictive. Moreover, while nominal processing has been described and detailed, and to some degree alternate work pieces and systems, assemblies, etc. with regard thereto referenced, contemplated processes are not so limited. Accordingly, the scope of the subject invention is as defined in the language of the appended claims, and includes not insubstantial equivalents thereto.

That which is claimed:

1. A heating assembly for operative union with a heat sink and/or work piece, the heating assembly comprising:

a. a heater characterized by a resistive heating element and a dielectric substrate, said resistive heating element supported upon said dielectric substrate, said heater including leads for operative union with a current source; and, b. a resistive sensor, substantially coextensive with said resistive heating element of said heater and united with said heater so as to define a composite heating assembly, said resistive sensor characterized by a first resistive sensor portion having a resistive material delimiting a first resistive pattern and a second resistive sensor portion having a resistive material delimiting a second resistive pattern, said resistive sensor monitorable in real time for a detection of a change in resistance response time related to a change in a conductive interface for, between and among said heater and the heat sink and/or work piece.

2. The heating assembly of claim 1 wherein said resistive heating element of said heater comprises in excess of 50% of an effective heating area for said heater.

3. The heating assembly of claim 1 wherein said resistive heating element of said heater comprises an etched foil element.

4. The heating assembly of claim 1 wherein said resistive heating element of said heater comprises an etched resistive metal foil element, and said dielectric substrate comprises a polyimide film.

5. The heating assembly of claim 1 wherein said resistive sensor further comprises a dielectric substrate, said first resistive sensor portion and said second resistive sensor portion supported thereby.

6. The heating assembly of claim 1 wherein said resistive sensor further comprises a dielectric substrate, said first resistive sensor portion or said second resistive sensor portion supported thereby.

7. The heating assembly of claim 1 wherein said resistive sensor further comprises dielectric substrates, said first resistive sensor portion and said second resistive sensor portion interposed between said dielectric substrates.

8. The heating assembly of claim 1 wherein said resistive sensor further comprises first and second dielectric substrates, said first resistive sensor portion and said second resistive sensor portion interposed between said dielectric substrates, said first resistive sensor portion adjacent said first dielectric substrate, said second resistive sensor portion adjacent said second dielectric substrate.

9. The heating assembly of claim 1 wherein said resistive material of said first resistive sensor portion delimits a first resistive element and said resistive material of said second resistive portion delimits a second resistive element.

10. The heating assembly of claim 1 wherein said resistive material of said first resistive sensor portion is conductively united with said resistive material of said second resistive portion so as to define a resistive element.

11. The heating assembly of claim 1 wherein said first resistive sensor portion is operatively united with said second resistive portion so as to define a resistive circuit.

12. The heating assembly of claim 1 wherein said resistive sensor further includes a conductive adhesive, said conductive adhesive operatively uniting resistive material of said first resistive sensor portion with resistive material of said second resistive sensor so as to thereby delimit a resistive circuit.

13. The heating assembly of claim 1 wherein said first resistive sensor portion is in a stacked relationship relative to said second resistive sensor portion.

14. The heating assembly of claim 1 wherein said first resistive sensor portion is in a planar adjacent relationship relative to said second resistive sensor portion.

15. The heating assembly of claim 1 wherein said first resistive pattern of said resistive material of said first resistive sensor portion substantially conforms to/with said second resistive pattern of said resistive material of said second resistive sensor portion.

16. The heating assembly of claim 1 wherein said first resistive pattern of said resistive material of said first resistive sensor portion is reverse of said second resistive pattern of said resistive material of said second resistive sensor portion.

17. The heating assembly of claim 1 wherein said first resistive pattern of said resistive material of said first resistive sensor portion is complementary of said second resistive pattern of said resistive material of said second resistive sensor portion.

18. The heating assembly of claim 1 in operative combination with a heat sink.

19. A heating assembly for operative union with a heat sink and/or work piece, the heating assembly comprising:

a. a heater characterized by a resistive heating element and a dielectric substrate, said resistive heating element supported upon said dielectric substrate, said heater including leads for operative union with a current source; and, b. a resistive sensor, substantially coextensive with said resistive heating element of said heater and united with said heater so as to define a composite heating assembly, said resistive sensor characterized by a first resistive sensor portion having a first resistive element and a second resistive sensor portion having a second resistive element, said first resistive element including leads for operative union with a real time monitoring system, said second resistive element including leads for operative union with the real time monitoring system, comparative resistance monitoring of each of said resistive elements of said resistive sensor thereby effectuated in furtherance of detection of a change in a conductive interface for, between and among said heater and the heat sink and/or work piece.

20. A heating assembly for operative union with a heat sink and/or work piece, the heating assembly comprising:

a. a heater characterized by a resistive heating element and a dielectric substrate, said resistive heating element supported upon said dielectric substrate, said heater including leads for operative union with a current source; and, b. a resistive sensor, substantially coextensive with said resistive heating element of said heater and united with said heater so as to define a composite heating assembly, said resistive sensor characterized by a first resistive sensor portion having a resistive material delimiting a first resistive pattern and a second resistive sensor portion having a resistive material delimiting a second resistive pattern, said first resistive pattern and said second resistive pattern conductively united so as to delimit a resistive element/circuit, said resistive element including leads for operative union with a real time monitoring system in furtherance of detection of a change in a conductive interface for, between and among said heater and the heat sink and/or work piece.

* * * * *